US010203085B2

(12) United States Patent
Aruga

(10) Patent No.: US 10,203,085 B2
(45) Date of Patent: Feb. 12, 2019

(54) LIGHT SOURCE DEVICE

(71) Applicant: NICHIA CORPORATION, Anan-shi, Tokushima (JP)

(72) Inventor: Takanori Aruga, Suwa (JP)

(73) Assignee: NICHIA CORPORATION, Anan-shi (JP)

( * ) Notice: Subject to any disclaimer, the term of this patent is extended or adjusted under 35 U.S.C. 154(b) by 67 days.

(21) Appl. No.: 15/165,384

(22) Filed: May 26, 2016

(65) Prior Publication Data

US 2016/0348874 A1 Dec. 1, 2016

(30) Foreign Application Priority Data

May 29, 2015 (JP) ..... 2015-109958
Nov. 13, 2015 (JP) ..... 2015-223193

(51) Int. Cl.
*F21V 5/00* (2018.01)
*F21V 5/04* (2006.01)

(52) U.S. Cl.
CPC ..... *F21V 5/045* (2013.01)

(58) Field of Classification Search
CPC ..... F21V 5/045
See application file for complete search history.

(56) References Cited

U.S. PATENT DOCUMENTS 7,588,339 B2 * 9/2009 Matsui ..... G03B 15/0442 362/11
8,459,860 B2 * 6/2013 Saito ..... F21V 5/045 362/339
9,329,455 B2 * 5/2016 Saito ..... G03B 15/05
9,551,476 B2 * 1/2017 Saito ..... F21V 5/04
2014/0204592 A1 * 7/2014 Miyashita ..... F21S 48/115 362/311.06
2014/0293613 A1 * 10/2014 Saito ..... G03B 15/05 362/311.1
2015/0083193 A1 * 3/2015 Ueda ..... H01L 31/02168 136/246
2016/0254410 A1 * 9/2016 Mirhosseini-Schubert ..... H01L 33/08 348/371
2018/0097147 A1 * 4/2018 Ichikawa ..... H01L 33/22

FOREIGN PATENT DOCUMENTS

EP 2287932 A3 7/2015
JP 2011-044610 A 3/2011
JP 2011-171086 A 9/2011
JP 2011-192494 A 9/2011
JP 2012-113837 A 6/2012
JP 2013-068751 A 4/2013
WO 2012-063842 A1 5/2012
WO 2013-024836 A1 3/2015

* cited by examiner

*Primary Examiner* — Christle I Marshall
(74) *Attorney, Agent, or Firm* — Global IP Counselors, LLP

(57) ABSTRACT

A light source device includes a Fresnel lens having a light incidence surface and a light emission surface, and equipped with a light transmissive part and a light reflective part provided on an outside of the light transmissive part; and a light emitting element that is disposed opposite the light incidence surface of the Fresnel lens, and is disposed below the light transmissive part and part of the light reflective part on the light transmissive part side.

12 Claims, 3 Drawing Sheets

LIGHT SOURCE DEVICE

CROSS-REFERENCE TO RELATED APPLICATIONS

This application claims priority to Japanese Patent Applications No. 2015-109958 and No. 2015-223193 filed on May 29, 2015 and Nov. 13, 2015. The entire disclosures of Japanese Patent Applications No. 2015-109958 and No. 2015-223193 are hereby incorporated herein by reference.

BACKGROUND

1. Technical Field

The present disclosure relates to a light source device.

2. Description of Related Art

Many different light sources have been used in electronic devices in the past, and light source devices equipped with a light emitting diode that combines a fluorescence substance and a light emitting element have been used in recent years. Combining a Fresnel lens has also been proposed in order to make such light source devices thinner (for example, JP2013-68751A).

With a light source device such as this, some applications will require high luminance, good color reproducibility, and so forth, and such devices are sometimes used as the light source for a camera flash, for example, in which white light is reproduced by color mixing with a plurality of light emitting elements.

In this case, the colors of the fluorescence substances covering the light emitting element mounted in the light source devices are disposed directly on the side facing the subject, so there is a need for a screening effect that will make the colors of the various fluorescence substance layers less visible in the light source devices.

SUMMARY

The present disclosure was conceived in light of the above situation, and it is an object thereof to provide a light source device with which the transmission of light from the outside can be reduced without greatly decreasing the amount of light emitted from the light emitting element with respect to the amount of incident light, and thereby obtain a screening effect, that is, reduce the visibility from the outside of the individual light emitting elements disposed in the light source device or the fluorescence substance layers disposed on these elements.

The light source device of the present disclosure includes a Fresnel lens having a light incidence surface and a light emission surface, and equipped with a light transmissive part and a light reflective part provided on an outside of the light transmissive part; and a light emitting element that is disposed opposite the light incidence surface of the Fresnel lens, and is disposed below the light transmissive part and part of the light reflective part on the light transmissive part side.

With the light source device disclosed herein, the transmission of light from the outside can be reduced without greatly decreasing the amount of light emitted from a light emitting element with respect to the amount of incident light, and thereby obtain a screening effect, that is, reduce the visibility from the outside of individual light emitting elements disposed in the light source device or the fluorescence substance layers disposed on these elements, while ensuring the optical characteristics necessary and sufficient.

DETAILED DESCRIPTION

Embodiments for implementing the light source device of the present disclosure will be described below with reference to the accompanying drawings. In the following embodiment of the light source device that embody the technological concept of the present invention are just examples, and unless otherwise specified, the constituent parts discussed in the embodiments are not intended to limit the scope of the present invention.

Further, constitutions described in examples and the embodiments can be employed in other examples and embodiments.

The sizes and the arrangement relationships of the members in each of drawings are occasionally shown exaggerated for ease of explanation.

Embodiment 1: Light Source Device

Figure 1:
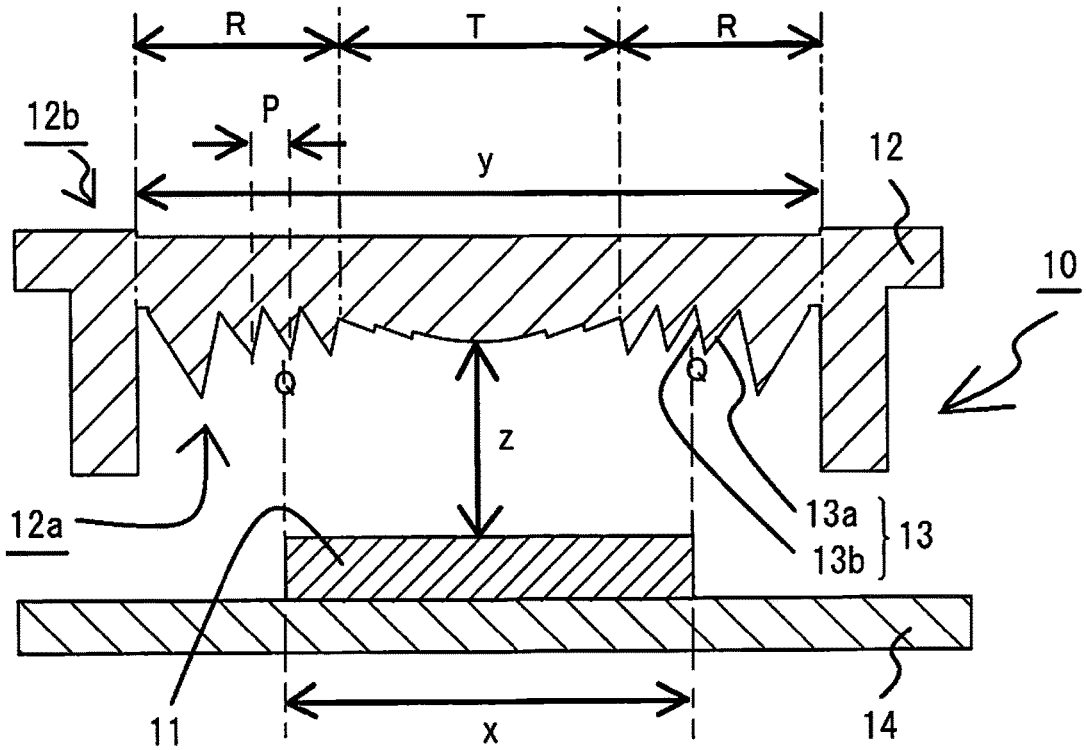
FIG. 1 is a schematic cross sectional view of one embodiment of the light source device according to the present disclosure.

As shown in FIG. 1, a light source device 10 of Embodiment 1 has a light emitting element 11 and a Fresnel lens 12. The light source device 10 has one light emitting element 11.

Fresnel Lens

Figure 2A:
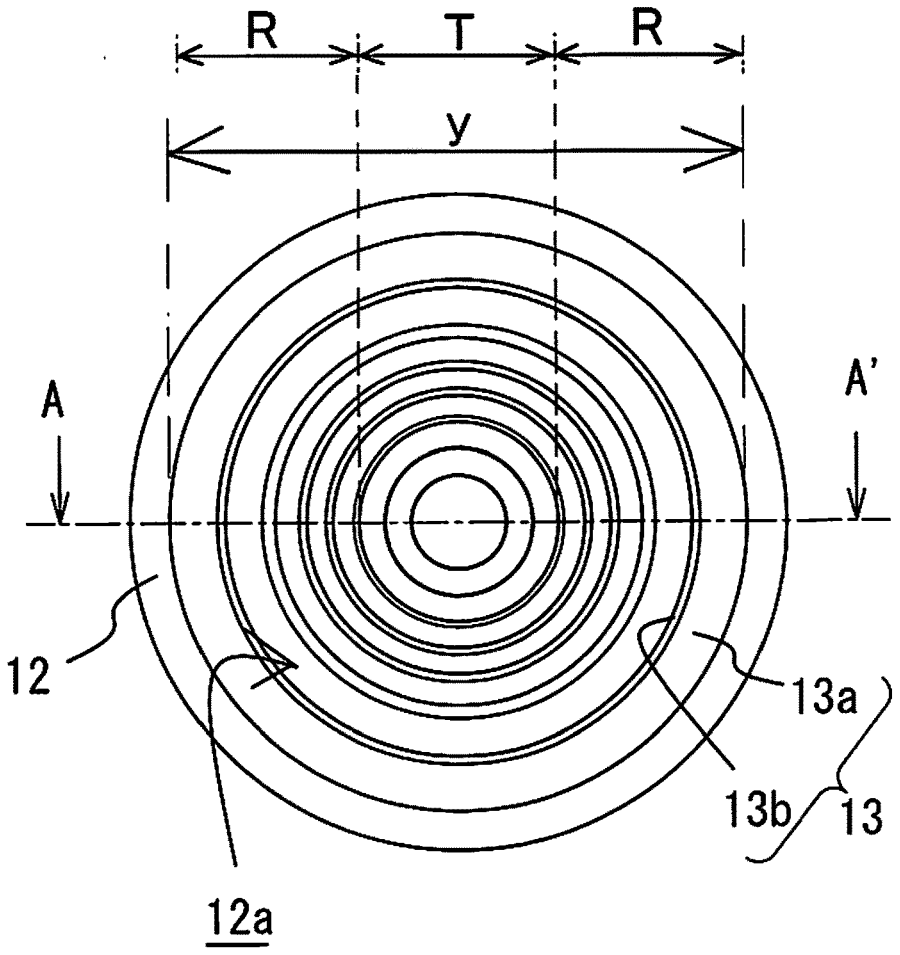
FIG. 2A is a schematic plan view of the Fresnel lens of the light source device in FIG. 1.
Figure 2B:
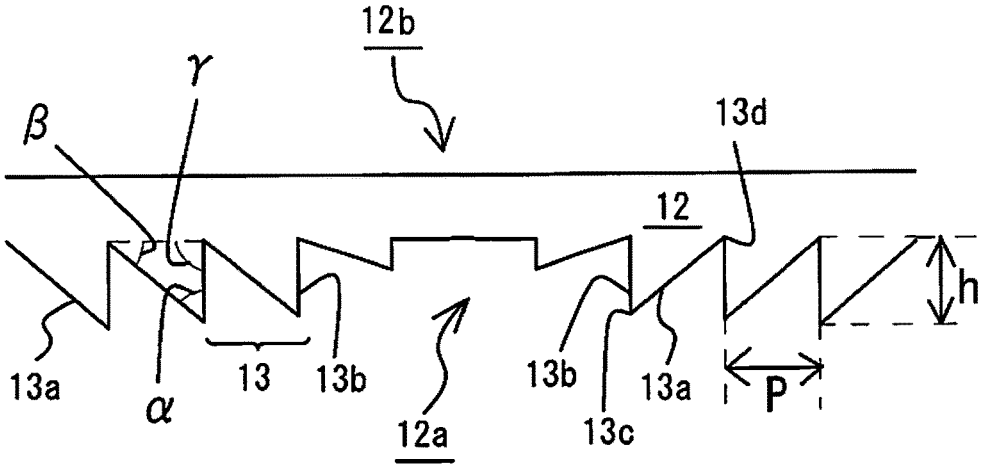
FIG. 2B is a schematic cross sectional view of A-A' line of Fresnel lens in FIG. 2A.

As shown in FIGS. 2A and 2B, the Fresnel lens 12 has a light incidence surface 12*a* and a light emission surface 12*b*. The light incidence surface 12*a* is the surface on which light emitted from a light emitting element 11 is incident, and this light is emitted from the light emission surface 12*b* to the backside of the light incidence surface 12*a* (i.e., to the outside).

The Fresnel lens 12 also has a light transmissive part T and a light reflective part R, which is provided on the outside of the light transmissive part T.

The light transmissive part T refers to the place where light incident on the Fresnel lens from the light incidence surface side is transmitted at the lens surfaces (discussed below).

At rise surfaces (discussed below) of the light transmissive part T, the light may be either transmitted or reflected.

On the light transmissive part T, light incident on the Fresnel lens from the light emission surface side (i.e., the outside) is also transmitted at the lens surfaces.

The light reflective part R refers to the places where light incident on the Fresnel lens from the light incidence surface side is transmitted at the rise surfaces (discussed below), heads toward the lens surfaces, and is reflected at the lens surfaces, and also refers to the places where light incident on the Fresnel lens from the light emission surface side (i.e., the outside) is reflected at the rise surfaces and heads toward the lens surface side, and is reflected at the lens surfaces and heads toward the rise surfaces.

As shown in FIG. 1, the Fresnel lens 12 has a plurality of unit lenses 13 on the light incidence surface 12*a*. Usually, a plurality of the unit lenses 13 are arranged in the circumferential direction. The unit lenses 13 are preferably arranged in concentric circles or concentric ellipses. This constitutes the region that functions as the Fresnel lens 12 (hereinafter also referred to as the Fresnel lens effective diameter).

The unit lenses 13 each have a lens surface 13*a* and a rise surface 13*b* located between lens surfaces 13*a*. The convex vertices 13*c* and concave vertices 13*d* at which the lens surfaces 13*a* and rise surfaces 13*b* are linked may both constitute an acute angle, or may be a rounded-off acute angle.

In particular, in the case that the convex vertices 13*c* are rounded off, light will be scattered more readily, and thus a better screening effect can be obtained.

In this specification, the angle of the unit lenses 13 at the convex vertices 13*c* at which the lens surfaces 13*a* and the rise surfaces 13*b* are linked shall be referred to as the Fresnel angle α, alfa, as shown FIG. 2B.

The cross sectional shape of the lens surfaces 13*a* and the rise surfaces 13*b* shown in FIG. 1 may be linear, or may be concave or convex curve to the inside.

There are no particular restrictions on the outer shape of the Fresnel lens 12 itself in plan view, and it may be square or some other polygonal shape, or may be circular or elliptical. However, as mentioned above, regardless of the outer shape, the region that functions as the Fresnel lens 12 is preferably circular or elliptical, with circular being especially preferable.

The part on the outside of the effective diameter of the Fresnel lens 12 is called the flange, which can be utilized in the attachment of the Fresnel lens 12, and the like.

It is usually preferable for the side of the Fresnel lens 12 that does not have the unit lenses 13, in other words, the light emission surface 12*b* in FIG. 1, to be flat or substantially flat so that the Fresnel lens 12 can be disposed horizontally with respect to the light emission surface of the light emitting element 11, but the surface may be given a textured finish.

The surface having a textured finish as referred to here may have partially regular roughness mixed in, but is substantially randomly textured. The size of the roughness here may be less than the height h of the unit lenses 13 (discussed below).

Also, in FIG. 1, the light incidence surface 12*a* has protrusions and depressions formed on it that constitute unit lenses (discussed below), but the shape of the base thereof may be flat, or one that constitutes a concave lens or a convex lens.

The maximum thickness within the effective diameter of the Fresnel lens is about 0.1 to 10 mm, for example, with about 0.5 to 5 mm being preferable.

The effective diameter of the Fresnel lens is, for example, at least about two times the width of a light emission surface of the light emitting element used in the light source device.

When x is the maximum width of the light emission surface of the light emitting element, and y is the effective diameter of the Fresnel lens, the relation of $1.0x \leq y \leq 2.5x$ (which is the relation of Formula (1)) preferably satisfies, for example. More specifically the effective diameter of the Fresnel lens may be about 1.5 to 5.0 mm.

From another standpoint, the effective diameter of the Fresnel lens is, for example, about 5 to 30 times the distance z between the light transmissive part of the Fresnel lens and the light emitting element used in the light source device, with about 7.5 to 25 times being preferable, and 8 to 15 times being more preferable.

The pitch P of the unit lenses 13 can be 100 μm or less, with 60 μm or less being preferable, 45 μm or less being more preferable, and 30 μm or less being still more preferable.

In general, in the case where an object is seen by the human, for example, by a person with visual accuracy of 20/20, a viewing angle of one minute (1/60°) is cited as being the minimum angle at which two separate points can be perceived.

When this person looks at a position 200 mm away, the minimum spacing at which two separate points can be perceived will vary with the visual acuity of the observer, but is roughly 60 μm, and it is known that two points separated by less than this spacing will be difficult to perceive as two points.

Because of this, the pitch P of the unit lenses 13 is set to 60 μm in this embodiment, so that the light will appear to be distributed uniformly over the entire Fresnel lens, without the boundaries between the unit lenses being perceivable, which provides a so-called screening effect.

In other words, in the case that the light emitting element 11 is disposed on the light incidence surface side of the Fresnel lens 12 as in FIG. 1, for example, the ranges over which the light emission surface of the light emitting element (i.e., the fluorescence substance layer) can and cannot be seen will be within a single pitch of the Fresnel lens.

Since the ranges over which the fluorescence substance layer can and cannot be seen is 60 μm or less, it is smaller than the minimum spacing that can be perceived by an observer, so the result is perceived as an intermediate color between the fluorescence substance layer and its surroundings (e.g., the substrate on which the light emitting element is installed), and the so-called screening effect can be effectively achieved.

The pitch P of the unit lenses 13 is preferably constant with the Fresnel lens, but within the above-mentioned range, the pitch may decrease gradually or in steps toward the center of the Fresnel lens.

There are no particular restrictions on the height h of the unit lenses 13, which may be constant within the Fresnel lens, but it preferably decreases gradually or in steps toward the center of the Fresnel lens.

This height h may be greater than, less than, or the same as the pitch P of the unit lenses 13, with an example being 100 μm or less, and with 80 μm or less being preferable.

The Fresnel angle α may be constant within the Fresnel lens, but in the light transmissive part T, this angle preferably increases gradually or in steps toward the center of the Fresnel lens, whereas in the light reflective part R, the angle preferably decreases gradually or in steps toward the center of the Fresnel lens.

A slope (lens angle β, beta) of the lens surfaces 13*a* of the Fresnel lens is preferably less than a slope of the rise surfaces 13*b* (discussed below). The slope of the lens surfaces 13*a* is expressed by the angle beta in FIG. 2B. The slope of the lens surfaces 13*a* (lens angle β) in the light transmissive part T is preferably at least 0.01°, rounding off the third decimal place, and more preferably between 0.01 and 30°. In the light reflective part R, the slope is preferably between 20° and 50°, and more preferably between 30° and 45°.

The slope (rise angle γ) of the rise surfaces 13*b* of the Fresnel lens is expressed by the angle gamma in FIG. 2B, and in the light transmissive part T, the slope is preferably between 60° and 90°, and more preferably 90°. In the light reflective part R, the slope is preferably between 60° and 89.99°, and more preferably between 75° and 85°.

Thus, the Fresnel lens has a light incidence surface and a light emission surface, and includes a light transmissive part and a light reflective part provided on the outside of this light transmissive part. With light incident from the light emission surface side (i.e., the outside), for example, at the light reflective part R, the light incident on the lens surfaces is reflected, is transmitted by the rise surfaces, and hits a light emitting element (discussed below) or a fluorescence substance layer disposed on this element, whereas light incident on the rise surfaces is reflected and hits a region that is different from the light emitting element or the fluorescence substance layer disposed on it.

As a result, from the light emission surface side (i.e., the outside), the color of the light emitting element or the fluorescence substance layer disposed on it is hard to see, and the screening effect is enhanced. Also, with light incident from the light incidence surface side, at the light reflective part R, light incident on the rise surfaces is transmitted and light incident on the lens surfaces is reflected, while at the light transmissive part T light incident on the lens surfaces is transmitted. Thus, there is no large decrease in the amount of light emitted from the light emitting element versus the amount of light that is incident.

At the light reflective part R, a large projection surface area of the rise surfaces is ensured, which affords a better screening effect. More specifically, the ratio of the rise surfaces to the lens surfaces (i.e., rise surfaces/lens surfaces) may be greater than that of the light transmissive part T.

Also, in this embodiment, because the proportion of the Fresnel lens accounted for by the light reflective part R is large, or more specifically, because the light emitting element is disposed not only below the light transmissive part T, but also below part of the light transmissive part side of the light reflective part, there is no large decrease in the amount of light emitted from the Fresnel lens (i.e., emitted light quantity) versus the amount of light incident on the Fresnel lens from the light emitting element (i.e., incident light quantity), and when the light source device is observed from the light emission surface side, the color of the light emitting element or of the fluorescence substance layer disposed on it is hard to see, so the screening effect is further enhanced.

Furthermore, when the light transmissive part T side and the opposite side are compared within the light reflective part R of the Fresnel lens, it is preferable for the ratio of the rise surfaces to the lens surfaces (i.e., rise surfaces/lens surfaces) to be greater on the opposite side than on the light transmissive part T side. For example, it is preferable for the value of rise surfaces/lens surfaces to increase gradually from the light transmissive part T side toward the opposite side.

A Fresnel lens can be manufactured by a known method, and from materials known in this field. Resin and glass are examples of materials.

Such materials may contain a light scattering material or the like. Examples thereof include an inorganic fiber filler such a glass fiber and wollastonite, an inorganic filler such as aluminum nitride and carbon, silica, titanium oxide, zirconium oxide, magnesium oxide, grass, crystalline or sintered compact of the fluorescence substance, sintered compact of the fluorescence substance and the inorganic binder.

A protective film, a reflective film, an antireflective film, or the like may be formed on the light incidence surface and/or light emission surface of the Fresnel lens.

An example of an antireflective film is one with a four-layer structure composed of silicon dioxide and zirconium dioxide. This will improve the efficiency of light emission from the light emitting element, while reducing the transmission of light from the outside, and effectively bringing the screening effect.

Examples of methods for manufacturing a Fresnel lens 12 include injection molding, precision grinding, laser machining, and various other such methods.

The light emission surface 12*b* of the Fresnel lens 12 has a random textured shape. The phrase "textured shape" here means that the height of the unit lenses 13 on the light incidence surface 12*a* is lower or shallower than the height or depth constituted by the lens surfaces 13*a* and the rise surfaces 13*b*.

In other words, "textured shape" refers to irregular surface produced by texturing or matte finishing. More specifically, this can be accomplished by sandblasting, shot blasting (i.e., centrifugal blasting), or other such physical processing, or by chemical processing such as etching with a solvent.

A shape such as this allows the emitted light to be uniformly scattered.

Light Emitting Element

The light emitting element 11 preferably includes at least a nitride semiconductor stack. In this nitride semiconductor stack, a first semiconductor layer (such as an n-type semiconductor layer), a light emitting layer, and a second semiconductor layer (such as a p-type semiconductor layer) are stacked in that order, constituting a stack that contributes to light emission.

A thickness of the nitride semiconductor stack is preferably about 30 μm or less. The nitride semiconductor stack may have a substrate on which semiconductor layers can be epitaxially grown, such as a sapphire ($Al_2O_3$) substrate, but need not have one.

There are no particular restrictions on types or materials of the first semiconductor layer, the light emitting layer, and the second semiconductor layer, but examples include Group III-V compound semiconductors, Group II-VI compound semiconductors, and various other semiconductors.

More specifically, examples include $In_XAl_YGa_{1-X-Y}N$ ($0 \leq X$, $0 \leq Y$, $X+Y \leq 1$) and other such nitride-based semiconductor materials, and InN, AlN, GaN, InGaN, AlGaN, InGaAlN, and so forth can be used. Any layer thickness and layer structure known in this field can be employed.

The nitride semiconductor stack preferably has both a first electrode (positive or negative) that is electrically connected to the first semiconductor layer, and a second electrode (negative or positive) that is electrically connected to the second semiconductor layer, on the same side of the stack (i.e., a surface of the second semiconductor layer side). In this case, the opposite side from the surface where the first and second electrodes are connected will function as the light emission surface.

The shape of the light emitting element is usually square, but may instead be circular or elliptical, or triangular, hexagonal, or some other polygonal shape. In this Specification, the "maximum width" of the light emission surface of the light emitting element refers to the length of a diagonal in the case of a square or the like, refers to the diameter in the case of a circle, refers to the major axis in the case of an ellipse, and so on, referring to a length that corresponds to the shape of the light emitting element.

A size of the light emitting element can be suitably adjusted according to the size of the Fresnel lens with which it is combined. For instance, the outer edge of the light emitting element (Q in FIG. 1) is preferably of a size that will overlap the light reflective part R.

In other words, it is preferable for the light emitting element to be of a size that will fit not only below the light transmissive part of the Fresnel lens, but also below part of the light transmissive part side of the light reflective part.

More specifically, the maximum width x of the light emission surface is from 0.9 to 2.9 mm, for example. Using a size such as this will allow the Fresnel lens to be made compact, and will also allow the light emitting device to be made more compact and thinner.

A thickness of the light emitting element 11 is preferably no more than 200 μm as the thickness including the electrodes, regardless of whether or not there is a substrate for semiconductor growth, and the thickness of the only nitride semiconductor stack is more preferably 20 μm or less.

A light transmissive member is preferably disposed over the light emission surface of the light emitting element 11. This light transmissive member preferably transmits at least 60%, more preferably at least 75%, and still more preferably at least 90% of the light emitted from the light emitting layer.

Such a member can be molded from a thermosetting resin, a thermoplastic resin, one of these resins that has been modified, a hybrid resin that contains one or more types of these resins, or the like. Example thereof include an epoxy/modified epoxy resin, a silicone/modified silicone/hybrid silicone resin, a polyimide (PI), a modified polyimide resin, a polyamide (PA), a polyethylene terephthalate resin, a polybutylene terephthalate (PBT), a GF reinforced polyethylene terephthalate (GF-PET), a polycyclohexaneterephthalate resin, a polyphthalamide (PPA), a polycarbonate (PC), a polyphenylene sulfide (PPS), a polysulfone (PSF), a polyether sulfone (PES), a modified polyphenylene ether (m-PPE), a polyether ether ketone (PEEK), a polyetherimide (PEI), a liquid crystal polymer (LCP), a ABS resin, a phenol resin, an acrylic resin, a PBT resin, a urea resin, a BT resin, a polyurethane resin, a polyacetal (POM), a ultrahigh molecular weight polyethylene (UHPE), a syndiotactic polystyrene (SPS), an noncrystalline polyacrylate (PAR) and a fluorine resin.

The light transmissive member preferably contains a fluorescence substance that can convert the wavelength of light from the light emitting element. In the case where the fluorescence substance appears yellow, orange, red, or other such colors, the so-called screening effect in this embodiment will function effectively.

When a light transmissive member containing a fluorescence substance is disposed on the light emission surface of the light emitting element, in this Specification, the shortest distance z between the light transmissive member of the Fresnel lens and the light emitting element (discussed below) refers to the shortest distance between the light transmissive member of the Fresnel lens and the upper surface of the light transmissive member containing the fluorescence substance.

Any fluorescence substance known in this field can be used. Examples thereof include cerium-activated yttrium.aluminum.garnet (YAG), cerium-activated lutetium.aluminum.garnet (LAG), europium- and/or chromium-activated nitrogen-containing calcium aluminosilicate ($CaO—Al_2O_3—SiO_2$), europium-activated silicates ($(Sr,Ba)_2SiO_4$), and manganese-activated fluoride complex phosphors such as $A_2MF_6$:Mn (where A is one or more of Li, Na, K, Rb, Cs, and $NH_4$, and M is one or more of Ge, Si, Sn, Ti, and Zr), such as $K_2SiF_6$:Mn (KSF), KSNAF ($K_2Si_{1-x}NaAl_xF6$:Mn), or $K_2TiF_6$:Mn (KTF), a luminescent material referred to as a so called nanocrystal or quantum dot, which is nano-size high-dispersive particles of semiconductor materials, for example group II-VI, group III-V and group IV-VI semiconductors, more specifically CdSe, core-shell type $CdS_xSe_{1-x}$/ZnS, GaP, InP, and GaAs. These may be used singly or in combinations of two or more.

The light transmissive member may include a filler (such as a diffusion agent or a colorant). Examples include silica, titanium oxide, zirconium oxide, magnesium oxide, glass, fluorescence substance crystals or sintered fluorescence substance, and a sinter of a fluorescence substance and an inorganic binder.

There are no particular restrictions on a thickness of the light transmissive member, but an example is about 1 to 300 μm, with about 10 to 250 μm being preferable, and with about 10 to 200 μm being more preferable. In other words, a thickness that is 5 to 10% of the effective diameter of the Fresnel lens, and a thickness of about 6 to 7% is preferable. Another example is a thickness that is equal to or less than the shortest distance z between the light transmissive member of the Fresnel lens and the light emitting element, with 20 to 100% being preferable.

The light transmissive member is preferably stacked by spraying. The upper surface of the light transmissive member (i.e., the light extraction surface) may be flat, or this upper surface (i.e., light extraction surface) and/or the surface in contact with the light emitting element may be convex, concave, or some other non-flat surface.

The light emitting element 11 is preferably flip-chip mounted on a mounting board 14. Consequently, as discussed above, the surface of the opposite side from the surface where the first and second electrodes are connected can function as a light emission surface over the entire surface.

One light emitting element may be mounted on the substrate, or two or more may be mounted. The size, shape, and emission wavelength of the light emitting element can be selected as needed. When a plurality of light emitting elements are mounted, their layout may be irregular, regular (such as an array), or periodic. A plurality of light emitting elements may be connected in series, in parallel, in series-parallel, or in parallel-series.

The light emitting element is preferably covered by a sealing member, which is a member having the function of sealing (i.e., covering) part of the lateral surface of the light emitting element or fixing the light emitting element to a substrate.

The sealing member can be molded from a ceramic, resin, dielectric, pulp, glass, a composite of these materials, or the like.

The above-mentioned resins are particularly preferable from the standpoint of being able to obtain the desired shape with ease.

The sealing member may be light transmissive member, but is preferably made of a light blocking material. The reflectivity of the light blocking material with respect to the light from the light emitting element is preferably at least 60%, more preferably at least 75%, and still more preferably at least 90%.

Accordingly, it is preferred that the above-described material, for example, a resin contains a light reflection material, a light scattering material, a colorant and the like such as titanium dioxide, silicon dioxide, zirconium dioxide, potassium titanate, alumina, aluminum nitride, boron nitride, mullite, niobium oxide, zinc oxide, barium sulfate, carbon black and various kinds of rare earth oxides (e.g., yttrium oxide and gadolinium oxide).

The sealing member may contain glass fibers, wollastonite, or other such fibrous fillers, or carbon or other such inorganic fillers. It may also contain a material with good heat dissipation (such as aluminum nitride). Furthermore, the sealing member may contain a fluorescence substance (discussed below).

Layout of Light Emitting Element and Fresnel Lens

As discussed above, the light emitting element may be disposed opposite either the light incidence surface 12*a* or the light emission surface 12*b* of the Fresnel lens 12, but as shown in FIG. 1, for example, the light emitting element 11 is disposed opposite the light incidence surface 12*a* of the Fresnel lens 12.

The center (or center of gravity) of the light emitting element is preferably disposed to coincide with the light transmissive part of the Fresnel lens, and particularly its center (or center of gravity), that is, the center of the unit lenses arranged in concentric circles or in concentric ellipses.

The shortest distance z between the light transmissive member of the Fresnel lens 12 and the light emission surface of the light emitting element 11 is, for example, no more than one half the width x of the light emission surface of the light emitting element 11, and preferably satisfies the following Formula (2) ($0.1z \leq x \leq 2.0z$).

From another standpoint, the shortest distance z is, for example, no more than one quarter the effective diameter y of the Fresnel lens. More specifically, the shortest distance z is from 0.2 to 1.0 mm, for example.

In an embodiment, the Fresnel lens 12 and the light emitting element 11 preferably satisfy both of Formulas (1) and (2).

$$1.0x \leq y \leq 2.5x \quad (1)$$

$$0.1z \leq x \leq 2.0z \quad (2)$$

(where x is the maximum width of the light emission surface of the light emitting element, y is the effective diameter of the Fresnel lens, and z is the shortest distance between the light emitting element and the light transmissive part of the Fresnel lens).

In another embodiment, preferably the width x of the light emission surface of the light emitting element is no more than one half the effective diameter y of the Fresnel lens, and the shortest distance z between the light transmissive part of the Fresnel lens and the light emitting element is no more than one quarter the effective diameter y of the Fresnel lens and/or no more than one half the maximum width x of the light emission surface of the light emitting element.

Furthermore, it is preferable when the maximum width x of the light emission surface of the light emitting element is from 0.65 to 2.0 mm, the effective diameter y of the Fresnel lens is from 1.5 to 5.0 mm, and the shortest distance z between the light transmissive part of the Fresnel lens and the light emitting element is from 0.2 to 1.0 mm.

Embodiment 2: Light Source Device

Figure 3:
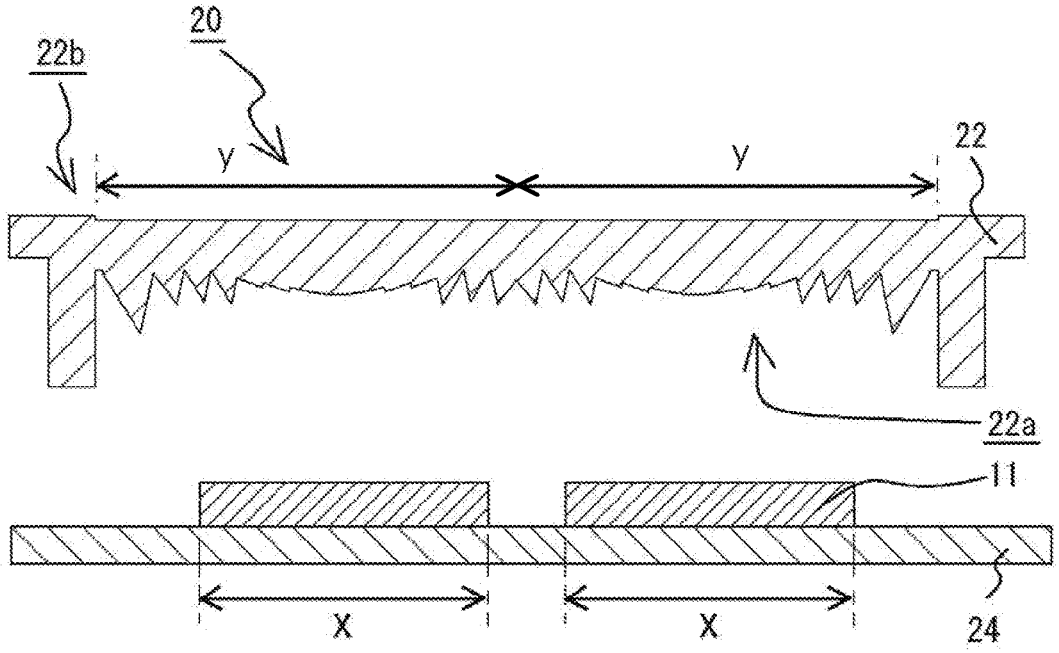
FIG. 3 is a schematic cross sectional view of another embodiment of the light source device according to the present disclosure.

As shown in FIG. 3, the light source device 20 in this embodiment has the light emitting elements 11 and a Fresnel lens 22.

This light source device has a plurality of (for example two) light emitting elements 11 on a mounting board 24.

In the case where two light emitting elements are provided here, it is preferable for one Fresnel lens to be combined with each of the light emitting elements 11.

However, the Fresnel lenses 22 themselves may be disposed not only independently and individually, but also linked at a portion outside the effective diameter of the Fresnel lenses.

Otherwise, this is substantially the same configuration as in the light source device 10. Thus, the same effect as with the light source device 10 is obtained.

INDUSTRIAL APPLICABILITY

The light source device of the present disclosure can be used for flashlight of camera, backlight light sources of liquid crystal displays, various kinds of lighting fixtures, and various kinds of display devices such as large displays, advertisements and destination guides, and image reading devices in digital video cameras, facsimiles, copiers, scanners and the like, projector devices, and light sources installed in or on a vehicle.

It is to be understood that although the present disclosure has been described with regard to preferred embodiments thereof, various other embodiments and variants may occur to those skilled in the art, which are within the scope and spirit of the invention, and such other embodiments and variants are intended to be covered by the following claims.

What is claimed is:

1. A light source device comprising:

a Fresnel lens having a light incidence surface and a light emission surface, and equipped with a light transmissive part and a light reflective part provided on an outside of the light transmissive part; and a light emitting element including a semiconductor stack and a pair of electrodes, the light emitting element being disposed to face the light incidence surface of the Fresnel lens at a position below the light transmissive part and part of the light reflective part adjacent to the light transmissive part of the Fresnel lens, wherein the Fresnel lens has a plurality of unit lenses arranged along a circumferential direction on the light incidence surface at the light reflective part, and the unit lenses have lens surfaces and rise surfaces located between the lens surfaces, are set to a pitch of 60 μm or less, and satisfy the following Formulas (1) and (2):

$$1.0x \leq y \leq 2.5x \quad (1)$$

$$0.1z \leq x \leq 2.0z \quad (2)$$

where x is the maximum width of a light emission face of the light emitting element, y is an effective diameter of the Fresnel lens, and z is the shortest distance between the light emitting element and the light transmitting part of the Fresnel lens, the shortest distance between the light emitting element and the light transmissive part of the Fresnel lens is from 0.2 to 1.0 mm.

2. The light source device according to claim 1, wherein the light emission surface of the Fresnel lens has a texture shape surface.

3. The light source device according to claim 1, wherein the maximum width of the light emission face of the light emitting element is from 0.9 to 2.9 mm.

4. The light source device according to claim 1, wherein the effective diameter of the Fresnel lens is from 1.5 to 5.0 mm.

5. The light source device according to claim 1, wherein the unit lenses have the convex vertices and concave vertices at which the lens surfaces and rise surfaces are linked, and each of the convex vertices and concave vertices is a rounded-off shape.

6. The light source device according to claim 1, wherein a height of the each unit lens decreases toward a center of the Fresnel lens.

7. The light source device according to claim 1, further comprising a light transmissive member disposed on the light emission surface of the light emitting element.

8. The light source device according to claim 7, wherein the light transmissive member contains a fluorescence substance that can convert a wavelength of light from the light emitting element.

9. The light source device according to claim 1, further comprising an additional Fresnel lens linked to the Fresnel lens, and an additional light emitting element disposed below the additional Fresnel lens.

10. The light source device according to claim 1, wherein the semiconductor stack of the light emitting element is a nitride semiconductor stack including a first semiconductor layer, a light emitting layer, and a second semiconductor layer.

11. The light source device according to claim 1, wherein the light emitting element is flip-chip mounted on a mounting board.

12. The light source device according to claim 1, wherein the light emission face of the light emitting element is arranged on an opposite side of a surface on which the electrodes are arranged.

* * * * *